US005132994A

United States Patent [19]

Kato

[11] Patent Number: 5,132,994

[45] Date of Patent: Jul. 21, 1992

[54] X-RAY MICROSCOPE

[75] Inventor: Mikiko Kato, Hachioji, Japan

[73] Assignee: Olympus Optical Co., Ltd., Tokyo, Japan

[21] Appl. No.: 598,139

[22] Filed: Oct. 16, 1990

[30] Foreign Application Priority Data

Oct. 20, 1989 [JP] Japan ..... 1-273530

[51] Int. Cl.[5] ..... G21K 7/00

[52] U.S. Cl. ..... 378/43; 378/210

[58] Field of Search ..... 378/43

[56] References Cited

U.S. PATENT DOCUMENTS 2,759,106 8/1956 Walter ..... 378/43

OTHER PUBLICATIONS

"Soft X-ray Imaging With a Normal Incidence Mirror", Underwood, Nature vol. 294-3 Dec. 1981 pp. 429-430.

Schmahl, et al., "X-Ray Microscopy", Springer Series in Optical Sciences, vol. 43, (Springer-Verlag) 1983.

Aoki, Applied Physics, vol. 56, No. 3, 1987, pp. 342-351.

Fraser, "The Soft X-Ray Quantum Detection Efficiency of Microchannel Plates", Nuclear Instruments and Methods 195, 1982, pp. 523-538.

Martin, et al., "Quantum efficiency of opaque CsI photocathodes with channel electron multiplier arrays in the extreme and far ultraviolet", Applied Optics, vol. 21, No. 23, Dec. 1982, pp. 4206-4207.

Henke, et al., "Low-Energy X-Ray Interaction Coefficients: Photoabsorption, Scattering, and Reflection", Atomic Data and Nuclear Data Tables 27 1-144, 1982.

*Primary Examiner*—Craig E. Church

*Attorney, Agent, or Firm*—Cushman, Darby & Cushman

[57] ABSTRACT

An X-ray microscope is provided with an X-ray source, a converging optical system collecting radiation emitted from the X-ray source, a stage on which an object is placed, and a detector having sensitivity with respect to radiation of wavelengths ranging from an X-ray region to a vacuum ultraviolet ray region, in which a filter eliminating long wavelength components from the radiation emitted from the X-ray source is disposed in an optical path from the X-ray source to the detector. Whereby, the X-ray microscope has important advantages in practical use that radiation of a desired wavelength region can be sensitively detected from the X-ray source, without bringing about large size and high cost of the optical instrument even where the X-ray source is used as a radiation source for white light.

15 Claims, 18 Drawing Sheets $R_1 = 19.45$ $H_1 = 7.3$
$R_2 = 10.16$ $H_2 = 2.4$
$S_1 = 8.75$
$S_2 = 8.25$
$d = 9.79$
$\ell = 950.36$

X-RAY MICROSCOPE

BACKGROUND OF THE INVENTION a) Field of the Invention

This invention relates to an X-ray microscope favorable to microscopy for biological specimens and the like.

b) Description of the Prior Art

Recently, for the purpose of microscopy for biological specimens, the development of a microscope has taken place which is suitable for a soft X-ray region, and more particularly for X rays with wavelengths of nearly 20–44 Å termed "water window".

This microscope is intended to secure an image of an object by radiating the X rays emitted from a radiation source onto the object to detect radiation transmitted through the object and secondary radiation generated from the object by an X-ray detector.

For the source of soft X rays, an electron-beam source bringing about characteristic X rays is commercially available. In addition to this, a synchrotron very excellent in brightness and a laser plasma source excellent in brightness and repetition performance have come into wide use for research.

FIG. 1A shows the spectrum of light emitted from a synchrotron radiation source [G. Schmahl, "X-Ray Microscopy", Springer Series in Optical Sciences, Vol. 43, (Springer-Verlag) (1983)] and it will be seen from this diagram that synchrotron radiation is white light with a wide wavelength band. Further, FIG. 1B depicts the spectrum per unit solid angle and unit laser pulse of light emitted from a typical laser plasma source [Kazuo Tanaka, "Optical and Electro-optical Engineering Contact", Japan Optoelectro-Mechanics Association, Vol. 27, No. 4, p. 187 (1989)] and it will likewise be seen from this diagram that the laser plasma source also emits the white light, although its bandwidth is narrow compared with that of radiation light.

On the other hand, as optical systems in which the radiation coming from an X-ray source is converged onto the object and the radiation from the object is converged onto the detector are known, for example, reflecting optical systems like a Walter optical system such as is shown in FIG. 2A (in which a ray of light produced by reflecting mirrors assuming an ellipsoid and a hyperboloid formation is made incident at a grazing angle smaller than a critical angle) and a Schwarzschild optical system such as is shown in FIG. 2B and a diffracting optical system making use of a zone plate such as is shown in FIG. 2C.

Further, as detectors indicating the radiation of a wavelength region ranging from the X rays to vacuum ultraviolet rays are known an MCP (microchannel plate), channeltron, CCD image sensor, imaging plate, X-ray film, photoresist, etc.

The MCP is an electron multiplier with a high grade of efficiency which, in general, is widely used for the detection of charged particles and radiation. A typical MCP assumes such geometry as is shown in FIG. 3A. Its channels, which in most cases, are each about 10–50 μm in diameter, are electrically connected in parallel by electrodes located at the front and rear faces of the MCP, as shown in FIG. 3B, which are supplied with large bias voltages. When the charged particles and light are radiated, electrons are produced in the microchannel by a photoelectric effect and impinge on the channel wall to multiply in number, eventually turning to a considerably amplified output.

G. W. Fraser states the MCP detecting the radiation of wavelength ranging from the X-ray region to the vacuum ultraviolet ray region and in particular, a quantum detecting efficiency of the MCP in the region of wavelengths from 0.6 to 600 Å [Nuclear Instruments And Methods 195 (1982), p. 523–538]. A quantum detecting efficiency QE means a ratio of the number of discharged electrons to the number of incident photons and is represented by a function QE ($\theta$, E) of incident energy E [where E has the relation with a wavelength $\lambda$ that $\lambda$ (Å) = 12400/E (eV) and is equivalent] and an incident angle $\theta$ of the photon. FIG. 4A shows the relationship between the radiation of the wavelength $\lambda$ and the quantum detecting efficiency QE (10°, $\lambda$) of the MCP. Further, FIG. 4B shows the relationship between the quantum detecting efficiency QE (8°, $\lambda$), improved by combining the MCP with a CsI photocathode, and the wavelength Å [Appl. Opt./Vol. 21, No. 23/p. 4206 (1982)].

FIG. 5 shows the absorption spectrum of the photoresist (PMMA) (The Spectroscopical Society of Japan, The 21st Summer Seminar, p. 81).

Although the X-ray optical system is primarily designed so that both the reflecting optical system and the diffracting optical system accommodate the X rays of the wavelength region selected in particular, the reflecting and diffracting optical systems mentioned above have properties of making the radiation of wavelengths other than selected ones incident on image surfaces in such a manner that the reflecting optical system has a high reflectance in regard to the radiation of long wavelengths such as vacuum ultraviolet rays and the diffracting optical system diffracts the radiation of long wavelengths and is pervious to the radiation of short wavelengths. Further, the detector also possesses a property of responding mostly to the radiation of a considerably wide wavelength range as mentioned above. Hence, if the X-ray radiation source has the property of emitting white radiation, the light existing outside a desired wavelength region will also traverse the optical system to be detected by the detector and will be mixed as a noise.

Although, therefore, the noise has been eliminated in the past in such a way that only the radiation of the desired wavelength region is selected from the X-ray source by using a spectroscope, problems have arisen that the use of the spectroscope leads to large size and high cost of the optical instrument.

SUMMARY OF THE INVENTION

The object of the present invention is to provide an X-ray microscope capable of detecting sensitively the radiation of a desired wavelength region from an X-ray source, without bringing about large size and high cost of the optical instrument even where the X-ray source is replaced by a light source for white light.

This object is accomplished, according to the present invention, by the arrangement that in the X-ray microscope provided with an X-ray source, an optical system converging radiation emitted from the X-ray source, a stage on which a specimen is placed, and a detector having sensitivity with respect to radiation of wavelengths ranging from an X-ray region to a vacuum ultraviolet ray region, a first filter means eliminating long wavelength components from the radiation emitted from the X-ray source is disposed in an optical path from the X-ray source to the detector.

Further, according to the present invention, a second filter means eliminating short wavelength components from the radiation emitted from the X-ray source is disposed in the above optical path.

According to such arrangements, the provision of the filter means makes it possible to prevent undesirable radiation from being incident on the detector, and consequently an image of an object having little noise can be secured with a simple arrangement.

Moreover, in the present invention, an absorption filter absorbing a part of the radiation from the X-ray source can be used as the first filter means. As for the second filter means, a grazing incidence mirror reflecting a part of the radiation from the X-ray source can be used.

This and other objects as well as the features and the advantages of the present invention will become apparent from the following detailed description of the preferred embodiments when taken in conjunction with the accompanying drawings.

DESCRIPTION OF THE PREFERRED EMBODIMENT

Prior to the description of the embodiments according to the present invention, filter means used in the present invention will be explained in detail below.

When a substance layer with a thickness of d is provided in an optical path of light of high energy such as X rays, a spectral transmittance t (E) of the substance layer, with an absorption coefficient of the substance taken as μ [F. Biggs, "Analytical Approximations for X-ray Cross Sections II", Sandia Lab. Research Report SC-PRT-710507 (1971)], is given by $$t(E)=\exp(-d\cdot\mu) \quad (1)$$

The absorption coefficient μ is the amount depending on the kind of substance and the energy (namely, the wavelength) of incident light and has a general trend to diminish as the energy of radiation increases. Accordingly, the substance layer of this kind has the function of a high-pass filter and can behave as the high-pass filter (X-ray filter) with a desired spectral characteristic by selecting the material and thickness of the substance layer.

Figure 6:
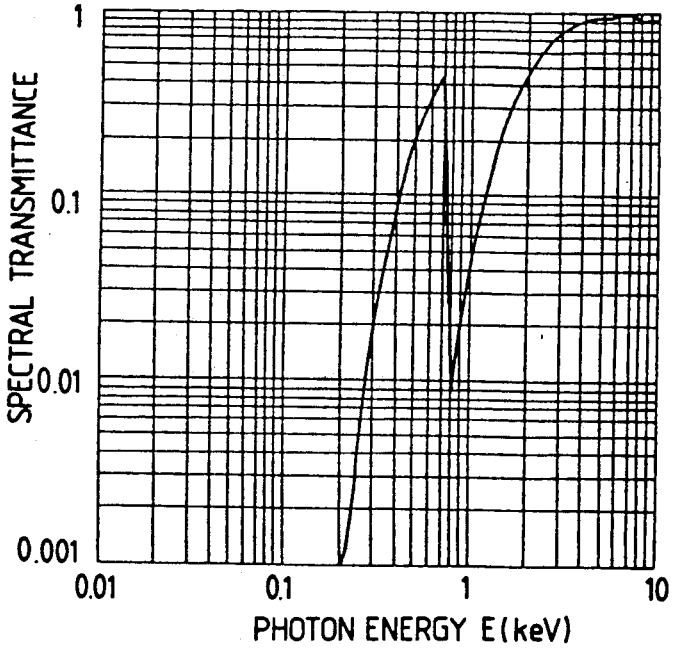
FIG. 6 is a diagram showing the spectral transmittance characteristic of an Fe filter of 0.5 μm in thickness which is an X-ray filter.

FIG. 6 shows the spectral transmittance characteristic of an Fe filter of d=0.5 μm calculated according to Equation (1). As is apparent from this figure, the X-ray filter suppresses the transmittance of radiation on the low energy side to a small value and therefore fulfils the function of the high-pass filter with respect to photon energy. Further, by varying the material and thickness of the filter, cutoff energy can be selected.

Next, when a ray of light is incident at a particular grazing angle on a plane mirror, its reflectance is given by $$R=\{(\theta-a)^2+b^2\}/\{(\theta+a)^2+b^2\} \quad (2)$$

where $$a^2=(\sqrt{(\theta^2-2\times\delta)^2+4\times\beta^2}+\theta^2-2\times\delta)/2$$

$$b^2=(\sqrt{(\theta^2-2\times\delta)^2+4\times\beta^2}-\theta^2-2\times\delta)/2$$

Here, the complex index of refraction of the substance constituting the mirror surface can be expressed as $n_c=1-\delta-i\beta$. Further, $$\delta=(N_a\cdot r_e\cdot\lambda^2\cdot f_1)/2\pi$$

$$\beta=(N_a\cdot r_e\cdot\lambda^2\cdot f_2)/2\pi$$

where $N_a$ is the number of atoms per unit volume, $r_e$ the classical electron radius, λ the wavelength of light, and $f_1$ and $f_2$ the scattering and absorption factors in the table of Henke [ATOMIC DATA AND NUCLEAR DATA TABLES, Vol. 27, No. 1, p. 1-144 (1982)]. Also, θ denotes the grazing angle of light.

Figure 7:
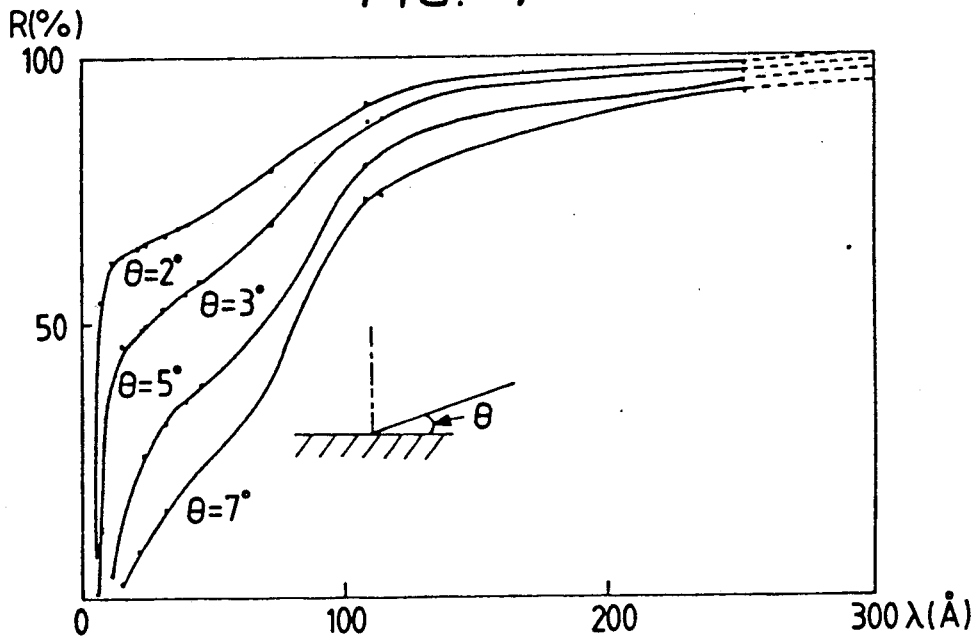
FIG. 7 is a diagram showing the reflectance characteristic of a grazing incidence mirror having a Pt reflecting surface.

The grazing incidence mirror, as shown in FIG. 7 [the dependence of the wavelength λ of the reflectance on a Pt reflecting surface at the grazing angle θ which is calculated from Equation (2)], has the effect that when radiation with various wavelengths is incident at particular grazing angles (2°, 3°, 5° and 7°), the reflectance of the radiation on the short wavelength side is suppressed to a small value. That is, it fulfills the function of the low-pass filter suppressing the radiation of high energy. Further, by changing the material of the mirror surface and the grazing angle, the cutoff energy can be selected.

As such, if the X-ray filter is used in combination with the grazing incidence mirror, a band-pass filter can be constructed. In particular, a proper selection of characteristics of the filter makes it possible to secure the filter transmitting selectively the radiation of the region of wavelengths of 10-100 Å called "water window" in which the following absorption edges of substances governing a living phenomenon exist.

| Substance | Absorption edge | Wavelength (Å) |
|---|---|---|
| P | L2, 3 | 94 |
| S | L3** | 75.1 |
| Na | K | 11.569 |
| C | K | 43.68 |
| N | K | 30.99 |
| Ca | L2 | 35.13 |
| | L3 | 35.49 |

[From: L. Henke, Atomic Data and Nuclear Data Tables 27, p. 1-144 (1982)]

Also, as the filter for this wavelength region, its thickness is moderate to range from nearly 5 to several μm (although it depends on substances as a matter of course). The filter of larger thickness will cut even the soft X rays and, with smaller thickness, the long wavelength light such as vacuum ultraviolet rays cannot be blocked. Furthermore, the filter of smaller thickness has difficulties in respect of the latest manufacturing technology and the strength.

In accordance with the embodiments shown, the present invention will be described in detail below. However, the substances constituting the filter means used in the present invention is not necessarily limited to those shown in individual embodiments.

FIRST EMBODIMENT

Figure 8:
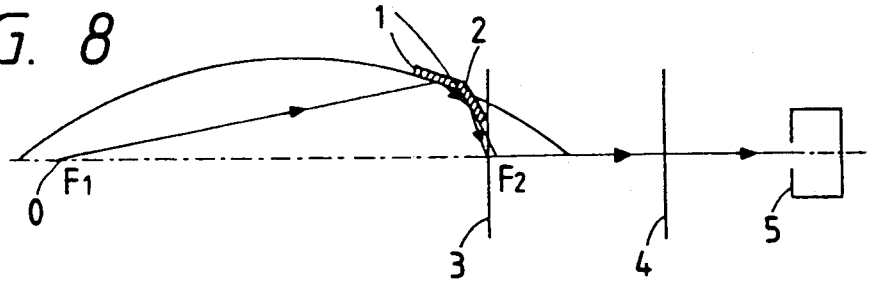
FIG. 8 is a view showing the optical system of a first embodiment of the X-ray microscope according to the present invention.

FIG. 8 is a schematic view showing the construction of a scanning X-ray microscope equipped with the Walter optical system. In this figure, the Walter optical system, though shown in regard to only the one side of the optical axis, has the arrangement in which an annular ellipsoidal mirror 1 and a hyperboloidal mirror 2 are coaxially connected with each other. Further, an X-ray source O is disposed at a focal point $F_1$ of the ellipsoidal mirror 1 and radiation emitted from the X-ray source O is reflected from the order of the ellipsoidal mirror 1 and the hyperboloidal mirror 2 and converged at a focal point $F_2$ of the hyperboloidal mirror 2. At this position is provided a stage on which a specimen is placed. The radiation transmitted through the specimen is conducted to a detector 5 through an X-ray filter 4. The stage 3 is such that a two-dimensional movement, which is possible in a plane normal to the optical axis, enables the specimen to be scanned by a radiation spot.

Figure 1A:
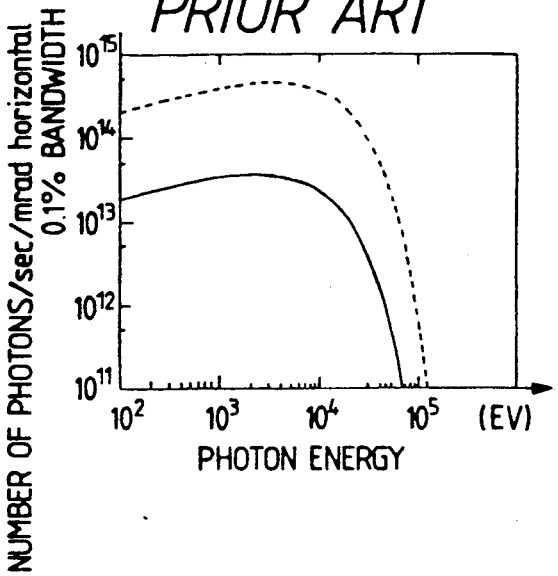
FIG. 1A PRIOR ART
FIGS. 1A and 1B are diagrams showing spectra of light emitted from a synchrotron radiation source and a laser plasma source, respectively.
Figure 1B:
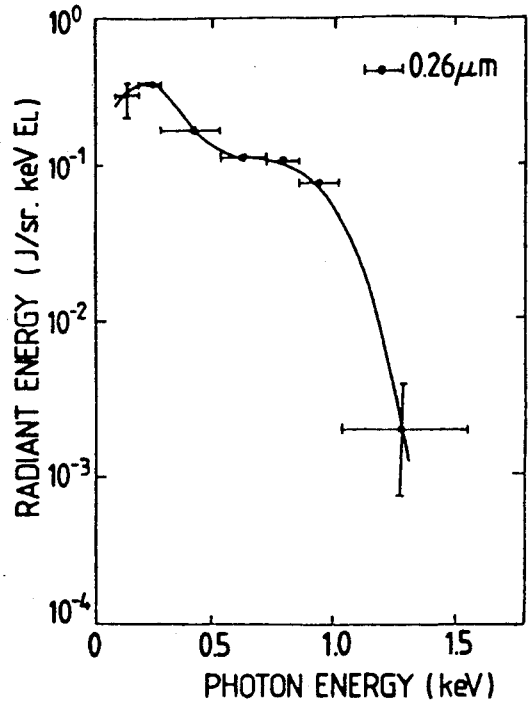
FIG. 1B PRIOR ART
Figure 3A:
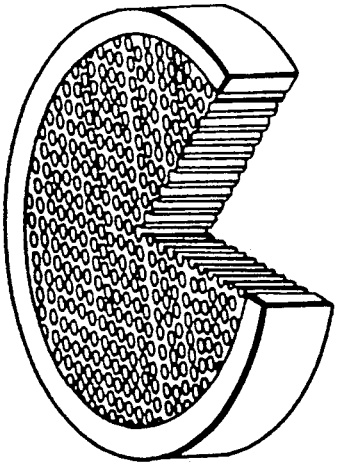
FIG. 3A PRIOR ART
FIGS. 3A and 3B are a perspective view of an MCP and a sectional view of the channel thereof, respectively.
Figure 3B:
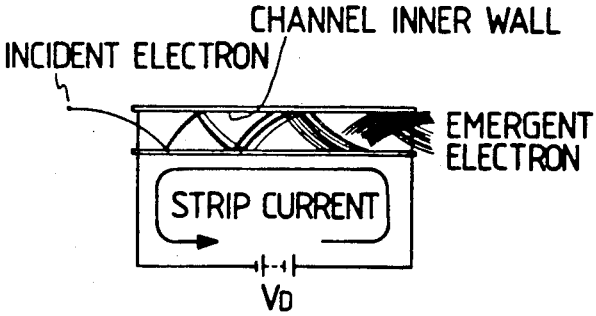
FIG 3B PRIOR ART

Here, the laser plasma source having the characteristic such as is shown in FIG. 1B is used as the X-ray source O, the Fe filter of the characteristic shown in FIG. 6 as the X-ray filter 4, and the MCP shown in FIG. 3 as the detector. Also, the entire system is contained in a vacuum vessel, although not shown. For a scanning technique, there is a method of providing a movable grazing incidence mirror on the optical axis, instead of changing the position of the stage, to move the radiation spot by turning the grazing incidence mirror.

In this embodiment, a detecting efficiency G(λ) of the radiation with the particular wavelength λ emitted from the radiation source is given by $$G(\lambda)=\frac{I(\lambda)}{I_{max}}\cdot\alpha(\lambda)\cdot t(\lambda)\cdot QE(\lambda) \quad (3)$$

where I(λ) is the spectrum of the radiation emitted from the plasma radiation source, I max the maximum of I(λ), α(λ) the convergent efficiency $=\int R_1 R_2\, d\omega$ (the integration covers the range of an effective solid angle at which the radiation can be incident on the optical system) of the Walter optical system, $R_1$ the reflectance at the ellipsoidal mirror 1, $R_2$ the reflectance at the hyperboloidal mirror 2, t(λ) the spectral transmittance of the X-ray filter 4, and QE(λ) the quantum detecting efficiency of the detector 5.

Figure 9:
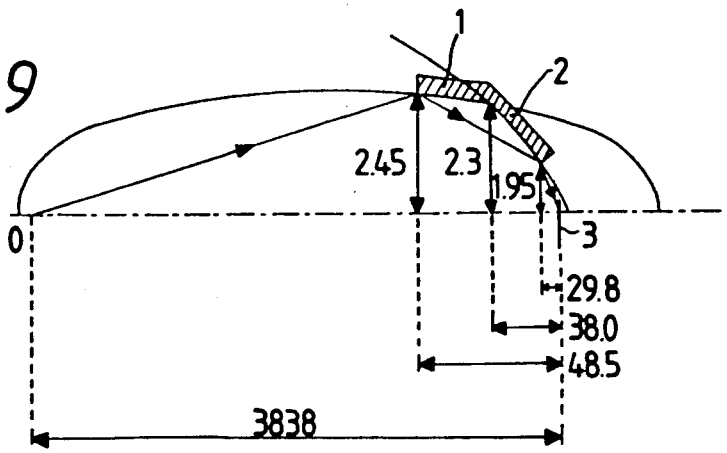
FIGS. 9 and 10 are diagrams showing the Walter optical system favorable for the first embodiment and the wavelength dependence of converging efficiency thereof.
Figure 10:
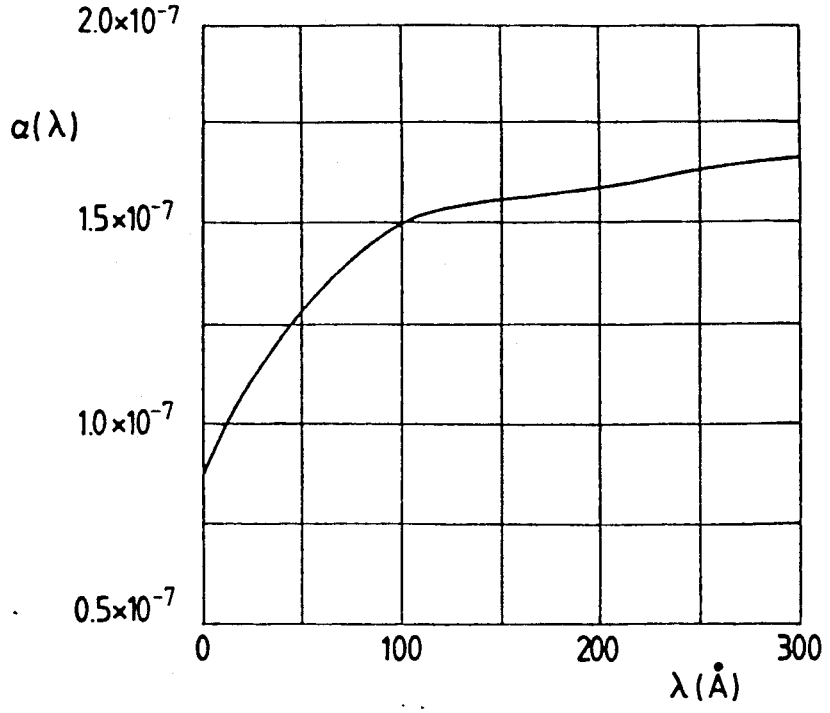

FIG. 9 shows the Walter optical system comprising a Pt reflecting mirror which is favorable for the embodiment and FIG. 10 depicts the wavelength dependence of the convergent efficiency α(λ) thereof.

Figure 4A:
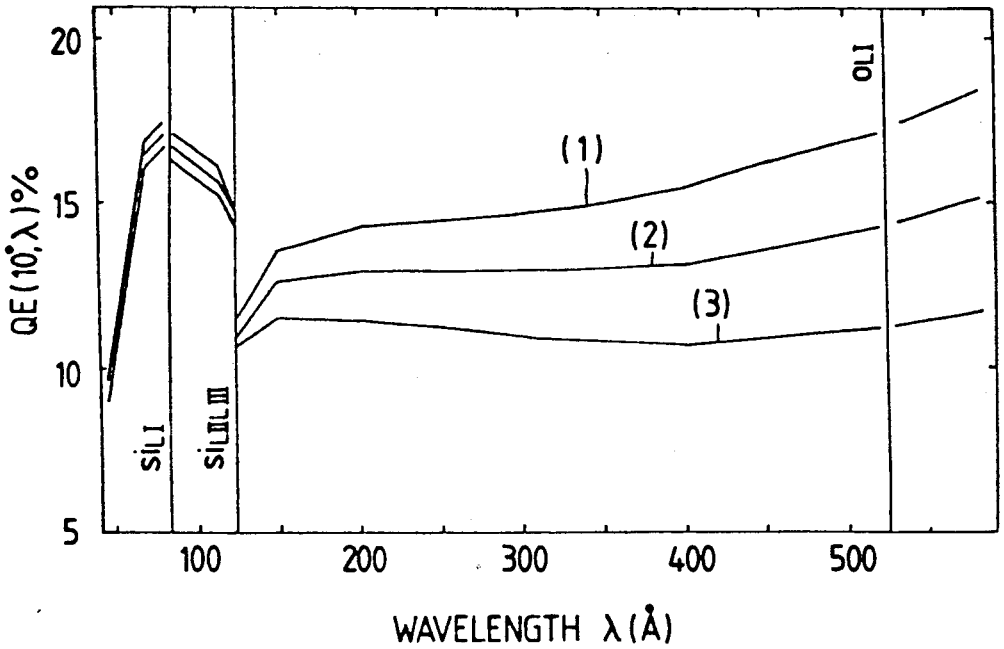
FIG. 4A PRIOR ART
FIGS. 4A and 4B are diagrams showing the quantum detecting efficiency in the MCP and in the case where the MCP is combined with a CsI photocathode, respectively.
Figure 4B:
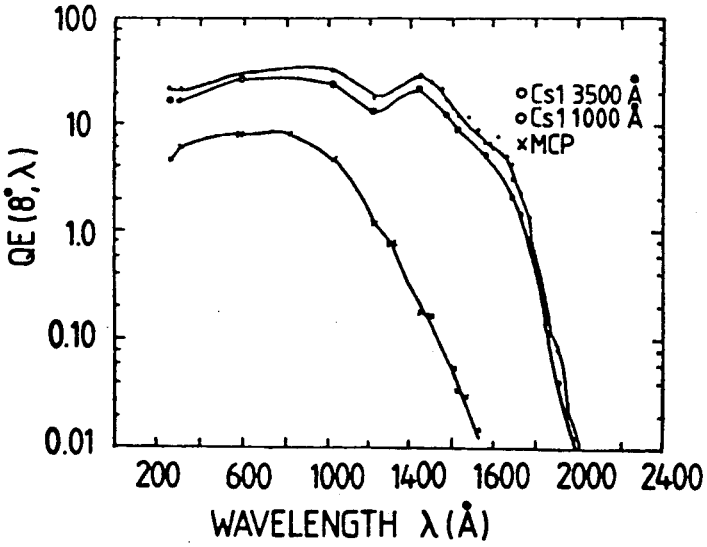
FIG. 4B PRIOR ART
Figure 5:
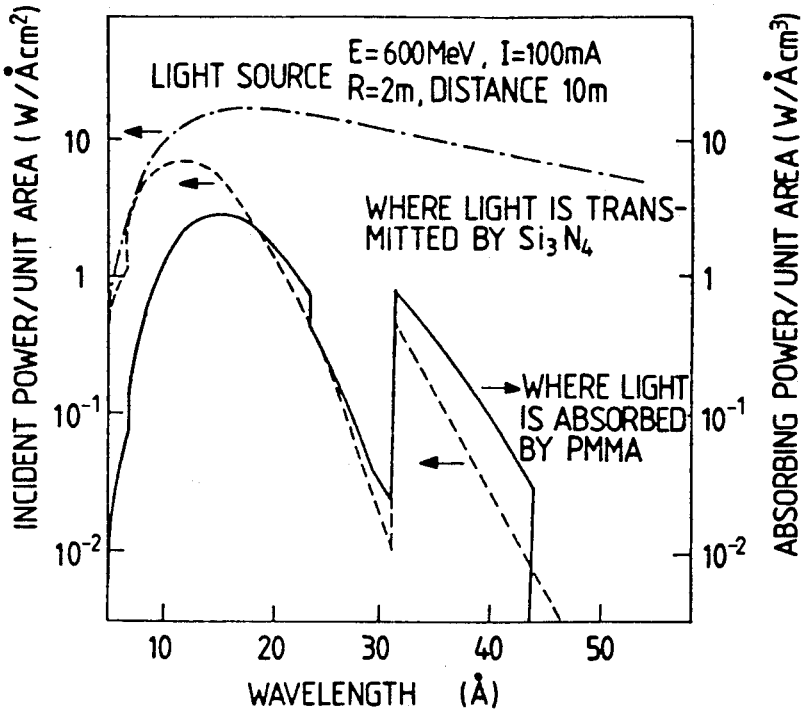
FIG. 5 PRIOR ART
FIG. 5 is a diagram showing the absorption spectrum of a photoresist.
Figure 11:
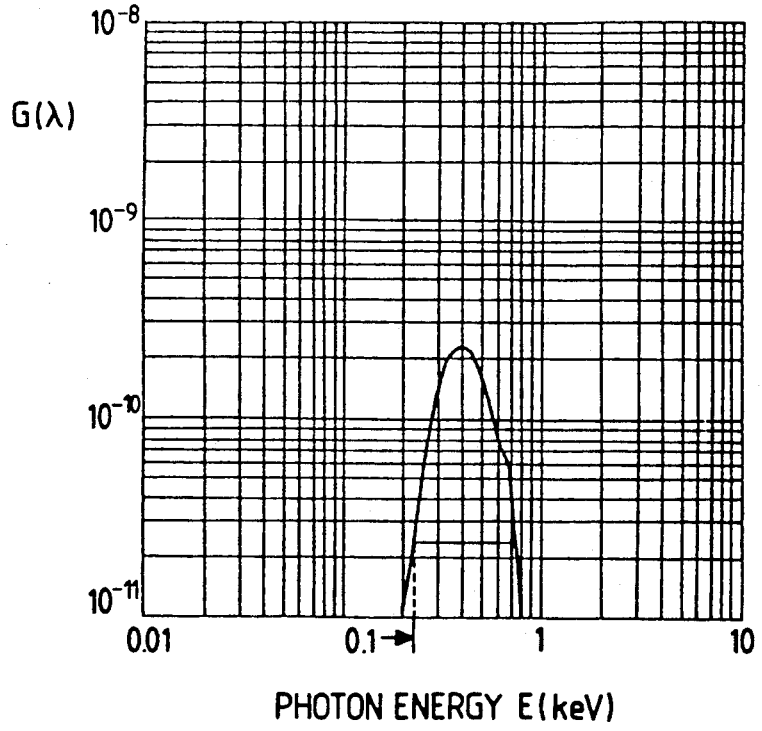
FIG. 11 is a diagram showing the detecting efficiency of particular wavelengths in a concrete example of the first embodiment.
Figure 12:
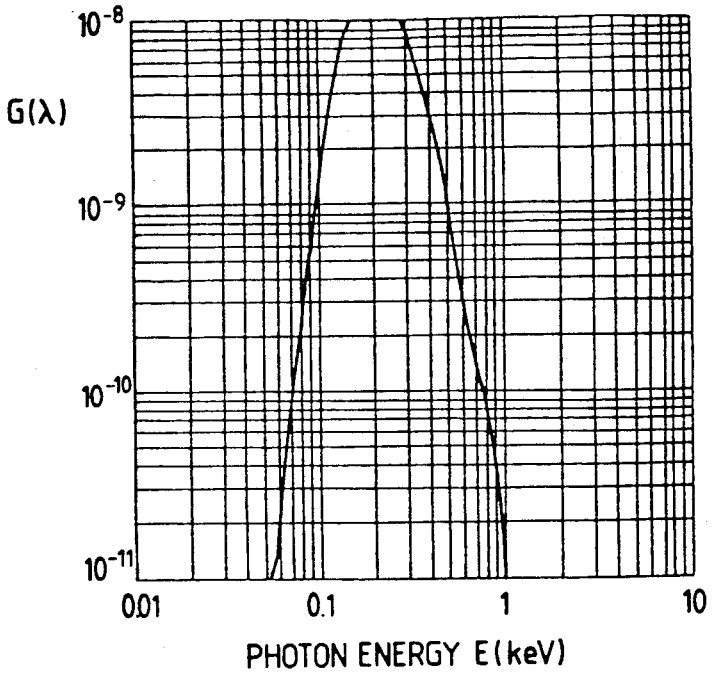
FIG. 12 is a diagram showing the detecting efficiency of particular wavelengths in a comparison example relating to the first embodiment.

FIG. 11 diagrams the detecting efficiency G(λ) calculated from Equation (3) with respect to the X-ray microscope constructed by the combination in which the Walter optical system such as is shown in FIG. 9 is adopted as a converging optical system, the laser plasma source radiating radiation with the spectrum shown in FIG. 1B as the X-ray source O, the filter having the spectral transmittance shown in FIG. 6, namely, the Fe filter with a thickness of 0.5 μm, as the X-ray filter 4, and the MCP of the characteristic shown in FIG. 4A as the detector 5. FIG. 12, on the other hand, shows the detecting efficiency G(λ) of an arrangement in which the X-ray filter 4 is removed from the preceding X-ray microscope.

In FIG. 11, energy where the detecting efficiency becomes about 10% of the maximum on the low energy side is approximately 230 eV, which is equivalent to 55 Å more or less in terms of the wavelength. Accordingly, the radiation of longer wavelength is cut by the X-ray filter. In FIG. 12, although the diagram may be rather hard to read because the peak of the detecting efficiency G(λ) is cut, the energy where the detecting efficiency G(λ) becomes about 10% of the peak is 100 eV more or less. It will thus be seen that the radiation of longer wavelengths is cut by the X-ray filter 4.

SECOND EMBODIMENT

Figure 13:
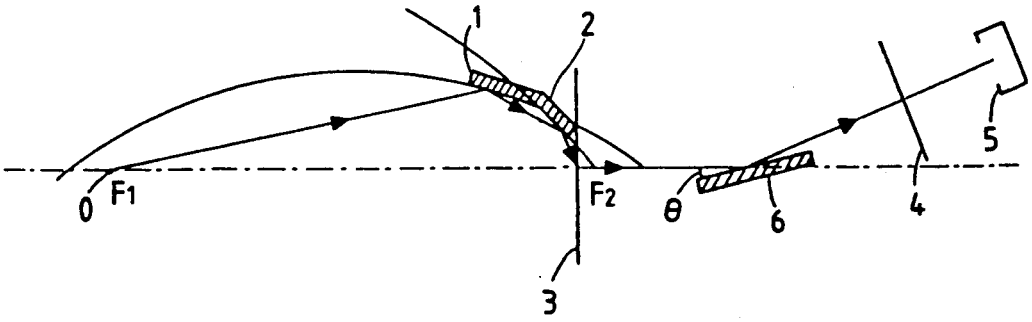
FIG. 13 is a view showing the optical system of a second embodiment.

FIG. 13 is a view showing an outline of the arrangement of a Walter type soft X-ray scanning microscope which is designed so that in the optical system of FIG. 8, a grazing incidence mirror 6 is disposed on the emergence side of the specimen and the radiation transmitted through the specimen, after being reflected from the grazing incidence mirror 6, is incident on the detector 5 though the X-ray filter 4.

The detecting efficiency G(λ) relative to the light of the wavelength λ of this embodiment is given by $$G(\lambda) = \frac{I(\lambda)}{I\max} \cdot \alpha(\lambda) \cdot R(\lambda) \cdot t(\lambda) \cdot QE(\lambda) \quad (4)$$

where R(λ) is the spectral reflectance of the grazing incidence mirror, which is as shown in FIG. 7.

Figure 14:
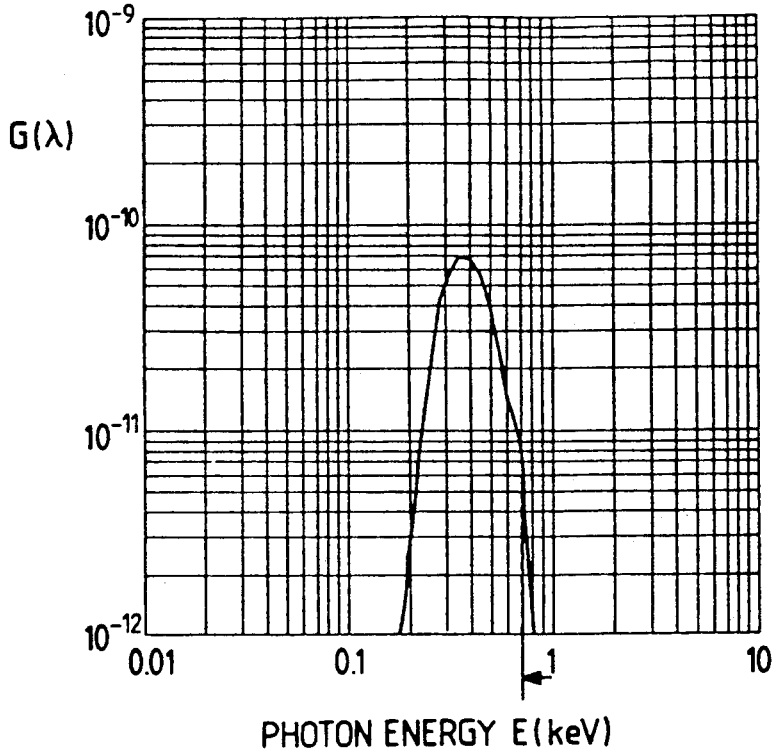
FIG. 14 is a diagram showing the detecting efficiency of particular wavelengths in a concrete example of the second embodiment.

FIG. 14 shows the detecting efficiency G(λ) calculated according to Equation (4) by adding a Pt grazing incidence mirror with a grazing angle of 5° to the example of FIG. 11. As is evident from this diagram, the photon energy where the value of the detecting efficiency G(λ) becomes about 10% of the peak is less than 700 eV and consequently the short wavelength region is cut to the extent of 18 Å. It will thus be seen that the use of the grazing incidence mirror makes it possible to cut the radiation of the short wavelength region compared with the example in FIG. 11.

THIRD EMBODIMENT

Figure 15:
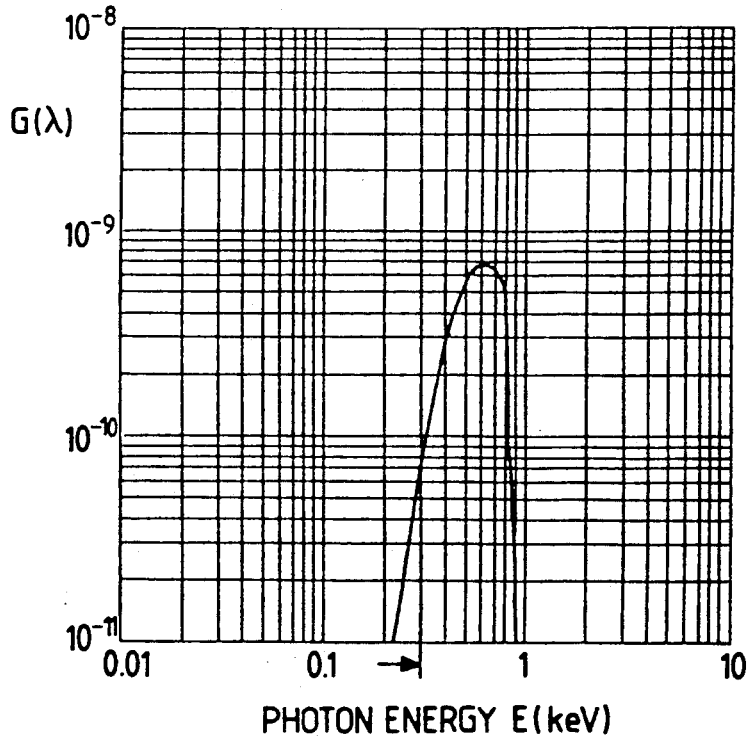
FIG. 15 is a diagram showing the detecting efficiency of particular wavelengths of a third embodiment.
Figure 16:
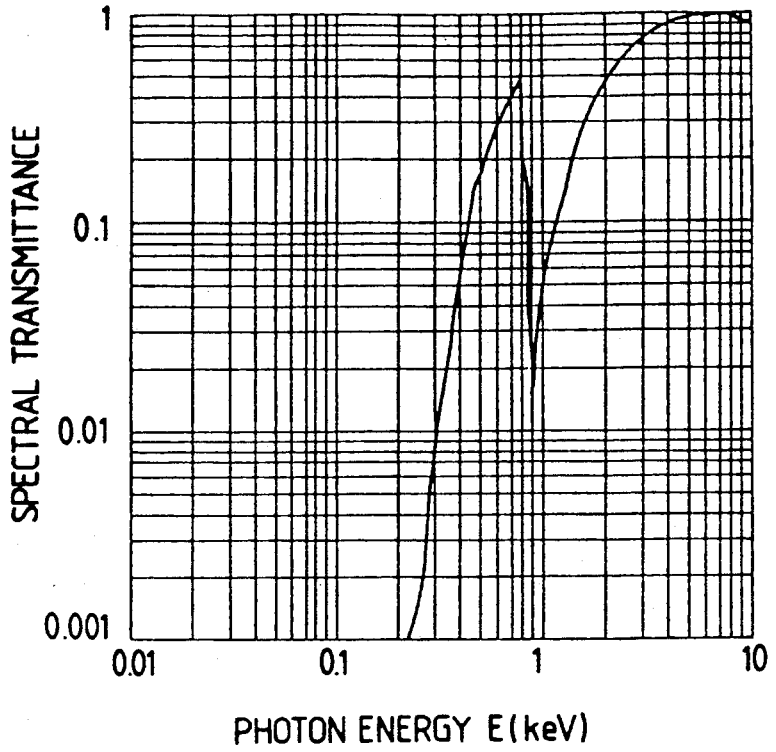
FIG. 16 is a diagram showing the spectral transmittance characteristic of the X-ray filter used in the third embodiment.
Figure 17:
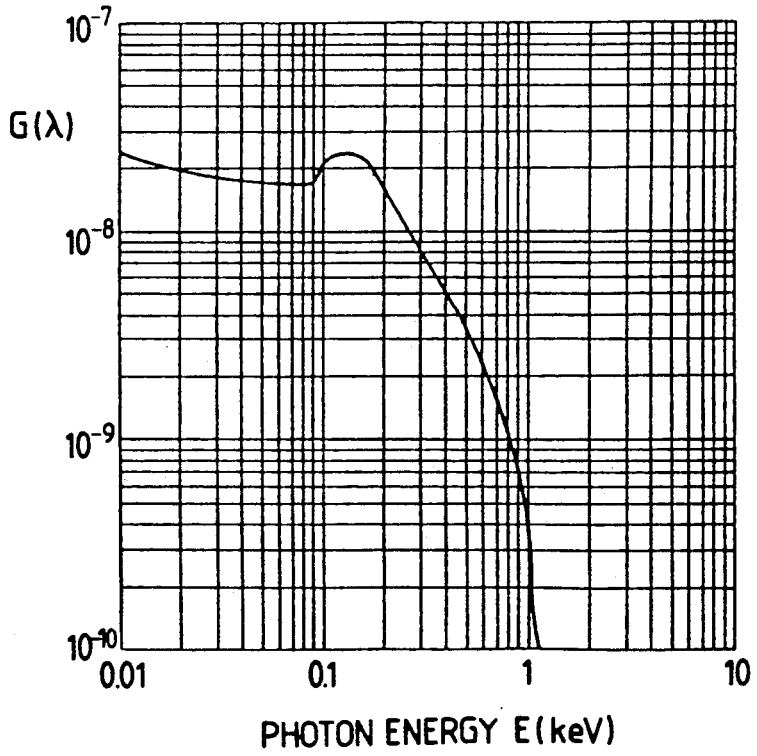
FIG. 17 is a diagram showing the detecting efficiency of particular wavelengths in a comparison example relating to the third embodiment.

FIG. 15 shows the detecting efficiency G(λ) calculated from Equation (3) in regard to the X-ray microscope constructed by the combination in which the Walter optical system such as is shown in FIG. 9 is adopted as the converging optical system, the synchrotron radiation source emitting the radiation with the spectrum shown in FIG. 1A as the X-ray source O, the filter having the spectral transmittance shown in FIG. 16, namely, an Ni filter with a thickness of 0.4 μm, as the X-ray filter 4, and the MCP of the characteristic shown in FIG. 4A as the detector 5. FIG. 17 depicts the detecting efficiency of the X-ray microscope devoid of the X-ray filter. As is evident from these diagrams, it is noted that the photon energy such that the S/N ratio of the detecting efficiency is held to nearly 10% (that is, such that the detecting efficiency becomes nearly 10% of the peak) comes to more than 300 eV and thus the long wavelength radiation is cut to the extent of 41 Å.

FOURTH EMBODIMENT

Figure 18:
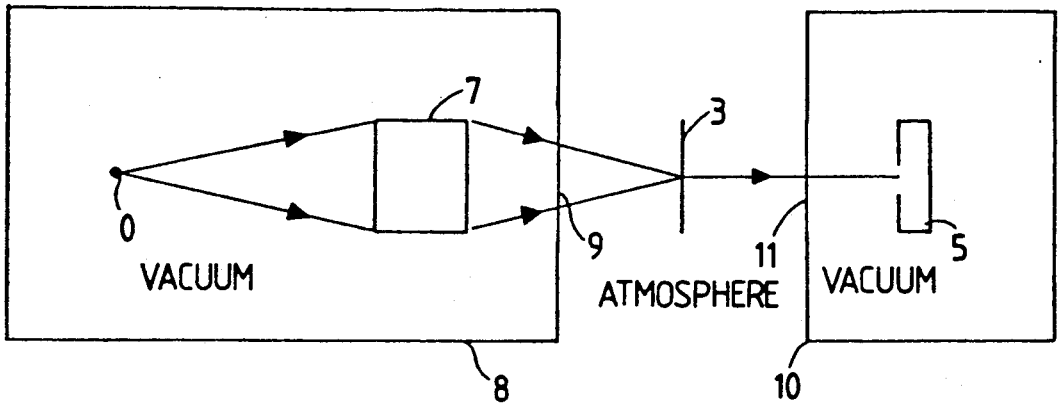
FIG. 18 is a view showing the optical system of a fourth embodiment.

FIG. 18 is a view showing an outline of the arrangement of a soft X-ray scanning microscope for microscopy of biological specimens. The radiation emitted from the X-ray source O and converged through an optical system 7 traverses a window member 9 of a vacuum chamber 8 to be incident on and transmitted through the specimen located in the atmosphere and after passing through a window member 11 of a vacuum chamber 10, is detected by the detector 5. At this time, the detecting efficiency G(λ) of the radiation with the wavelength λ is $$G(\lambda) = \frac{I(\lambda)}{I\max} \cdot \alpha(\lambda) \cdot t1(\lambda) \cdot AIR(\lambda) \cdot t2(\lambda) \cdot QE(\lambda) \quad (5)$$

where $t_1(\lambda)$ is the X-ray transmittance of the window member 9, $t_2(\lambda)$ the X-ray transmittance of the window member 11, and AIR(λ) the X-ray transmittance of an atmospheric layer in which the specimen and the stage 3 are located.

Figure 19:
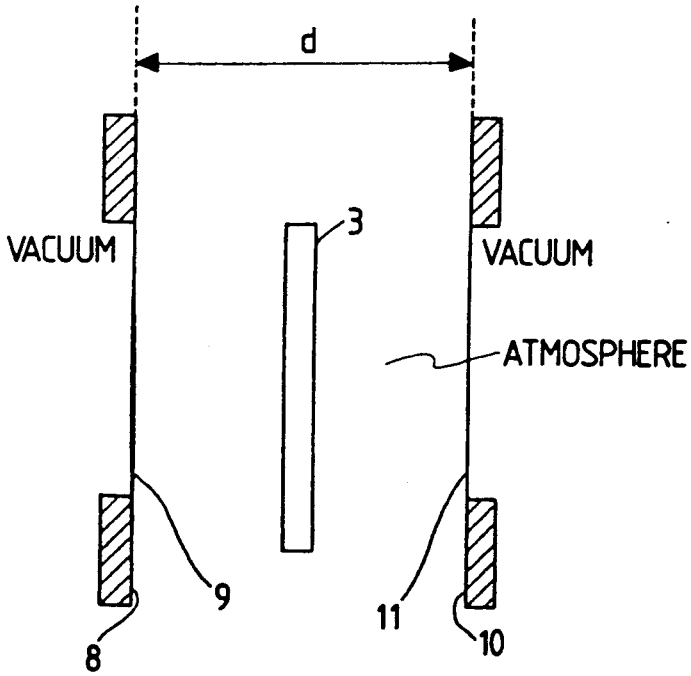
FIG. 19 is an enlarged view of an essential part of FIG. 18.

In this way, where a living body is observed in vivo, it is required that the specimen and the stage 3 are disposed in the atmosphere and, as illustrated in FIG. 19, a microscope body and a detecting section positioned in the vacuum chambers 8 and 10, respectively, are separated somehow from each other by windows. If the X-ray filters are used as the windows, the window members 9 and 11 separating the vacuum from the atmosphere will be secured and unnecessary radiation with low energy can be cut.

Figure 20:
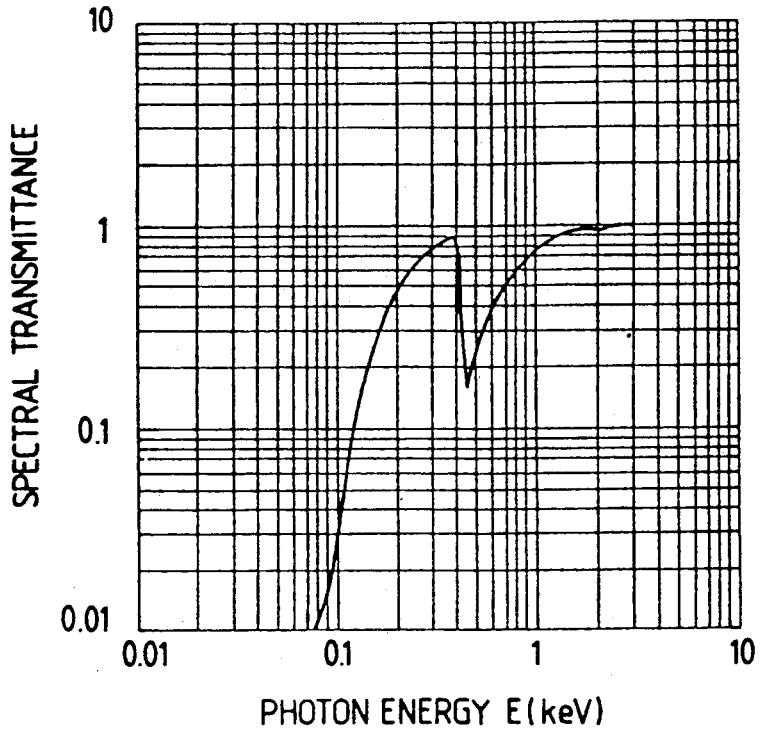
FIG. 20 is a diagram showing the spectral transmittance of an atmospheric layer applied to the fourth embodiment.

Moreover, the atmosphere between the microscope body and the detecting section serves as a high-pass filter such that the radiation with low energy is attenuated by the atmosphere per se, as seen from, for example, the spectral transmittance [of $N_2$(d=650 μm) constituting principally the atmosphere which is calculated from Equation (1)] shown in FIG. 20. Hence, even if the atmospheric layer exists, the high-pass filter with good performance can be designed.

Figure 21:
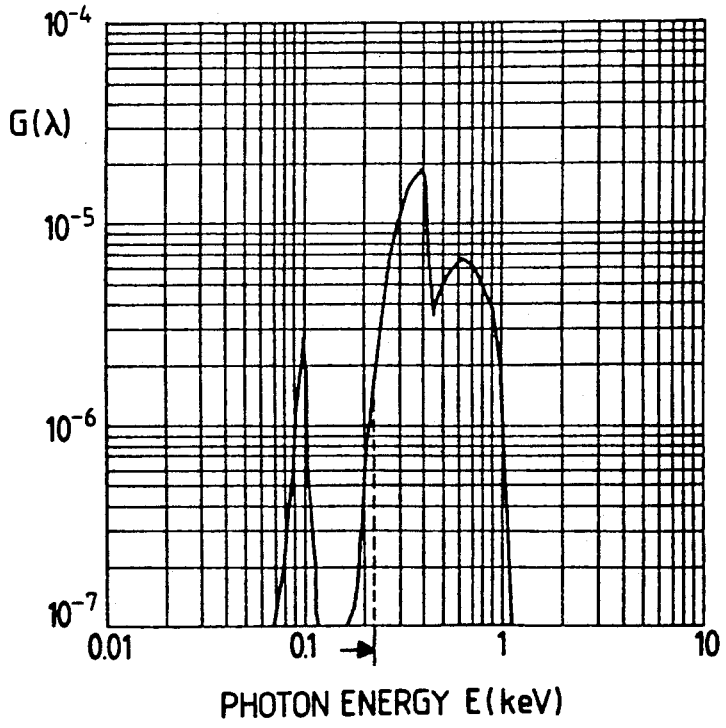
FIG. 21 is a diagram showing the detecting efficiency of particular wavelengths in a concrete example of the fourth embodiment.
Figure 22:
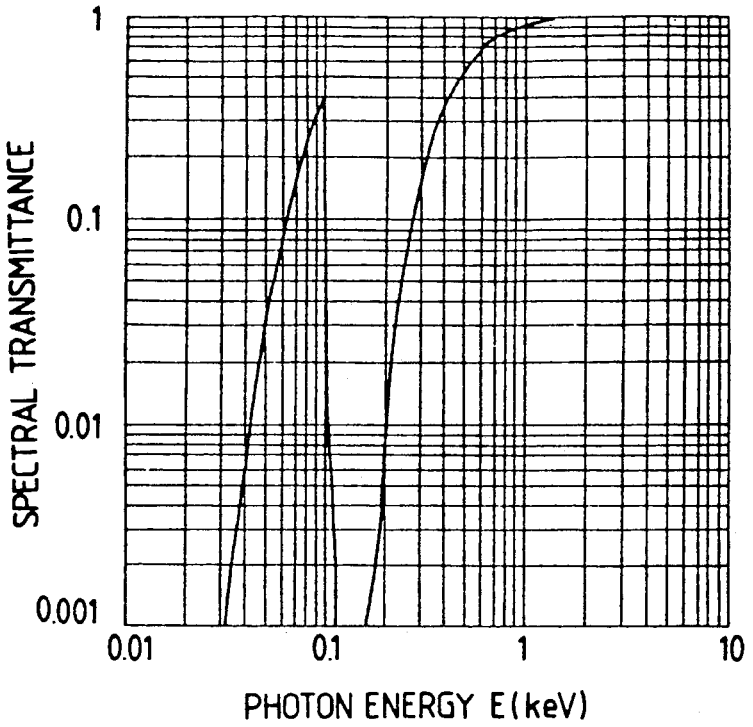
FIG. 22 is a diagram showing the spectral transmittance of a window member used in the concrete example of the fourth embodiment.

FIG. 21 shows the detecting efficiency G(λ) calculated from Equation (5) in relation to the X-ray microscope constructed by the combination in which the Walter optical system such as is shown in FIG. 9 is adopted as the converging optical system 7, the synchrotron radiation source emitting the radiation with the spectrum shown in FIG. 1A as the X-ray source O, Be filters each having a thickness of 0.3 μm (the spectral transmittance of a 0.6-μm-thick Be filter is as shown in FIG. 22) as the window members (X-ray filters) 9 and 11, a layer with a thickness of 650 μm (whose spectral transmittance is as shown in FIG. 20) as the atmospheric layer, and the MCP of the characteristic shown in FIG. 4A as the detector 5. As is evident from this diagram, it is seen that the region of wavelengths detected with the S/N ratio of more than 10% is reduced to less than nearly 60 Å.

FIFTH EMBODIMENT

Figure 23:
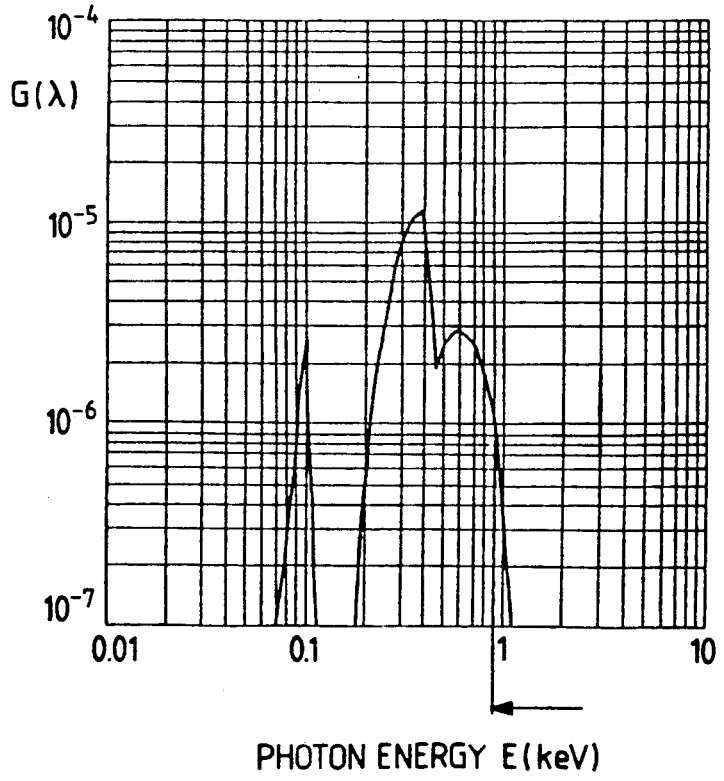
FIG. 23 is a diagram showing the detecting efficiency of particular wavelengths of a fifth embodiment.

FIG. 23 shows the detecting efficiency G(λ) of the radiation with the wavelength λ in the case where the Pt grazing incidence mirror with a grazing angle of 2° is disposed on the emergence side of the specimen in the X-ray microscope of FIG. 18. As is apparent from this diagram, it is seen that the radiation of the short wavelength region is cut to the extent of 15 Å compared with FIG. 21.

SIXTH EMBODIMENT

Figure 24:
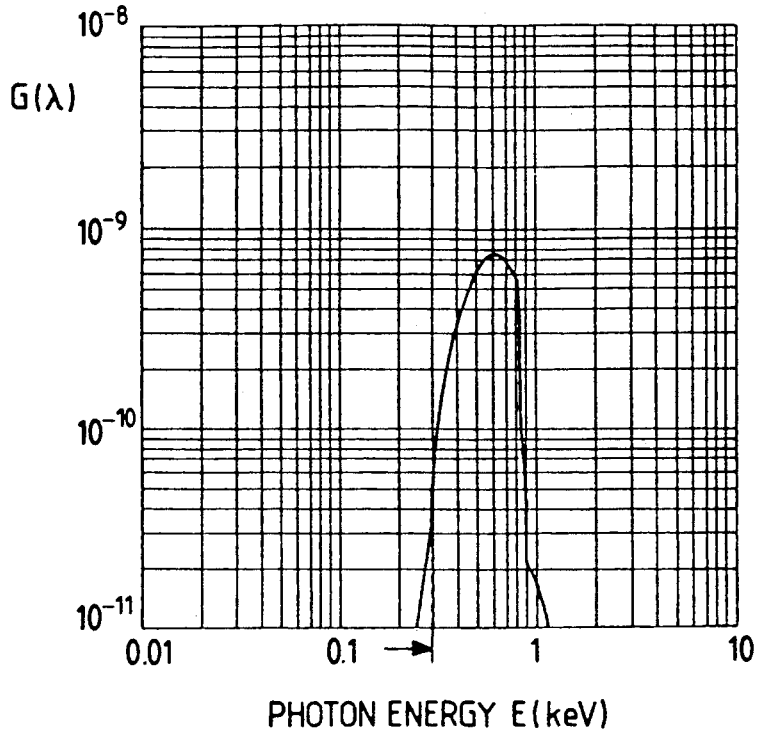
FIG. 24 is a diagram showing the detecting efficiency of particular wavelengths of a sixth embodiment.
Figure 25:
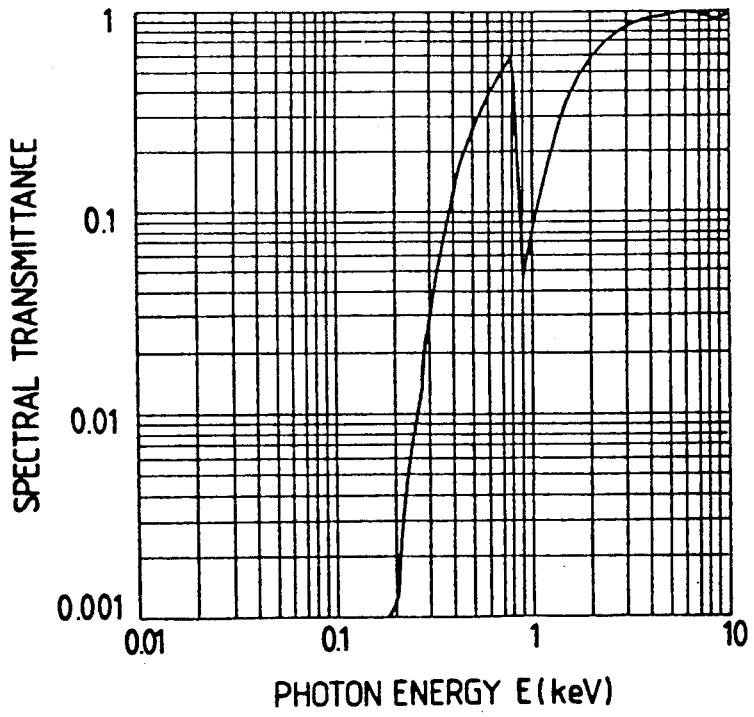
FIGS. 25 and 26 are diagrams showing the spectral transmittances of two types of window members used in the sixth embodiment.
Figure 26:
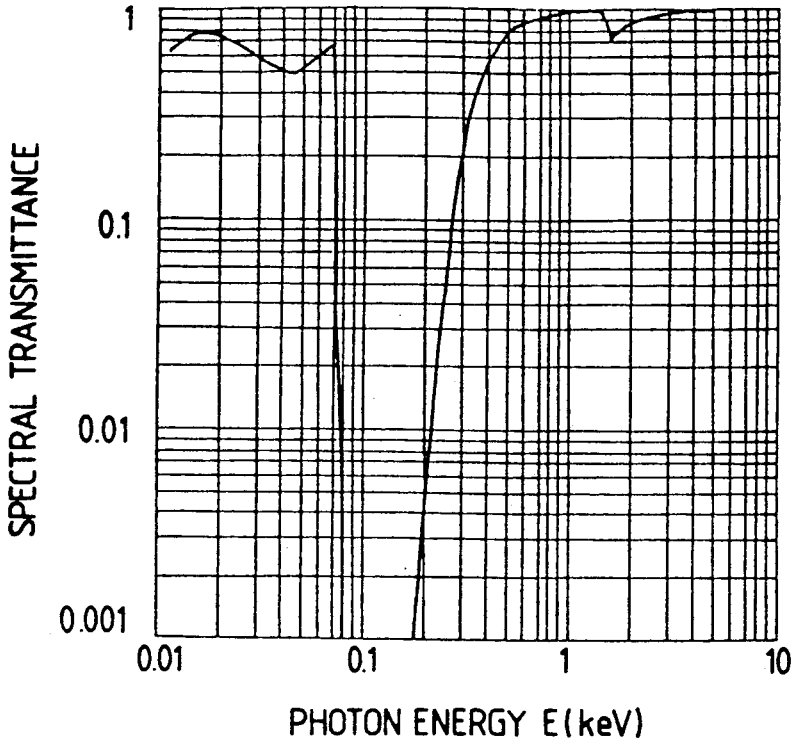
Figure 27:
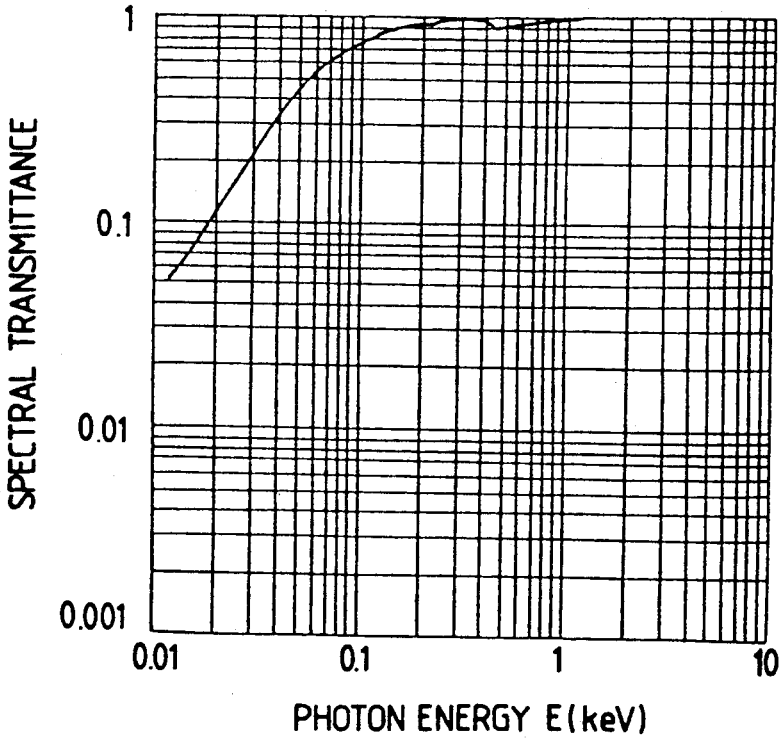
FIG. 27 is a diagram showing the spectral transmittance of the atmospheric layer applied to the sixth embodiment.

FIG. 24 shows the detecting efficiency G(λ) calculated from Equation (5) with respect to the X-ray microscope in which in FIG. 18, the Walter optical system such as is shown in FIG. 9 is adopted as the converging optical system 7, the synchrotron radiation source emitting the radiation of the spectrum shown in FIG. 1A as the X-ray source O, a 0.3-μm-thick Ni filter (whose spectral transmittance is as shown in FIG. 25) and a 0.3-μm-thick Al filter (whose spectral transmittance is as shown in FIG. 26) as the windows members (X-ray filters) 9 and 11, respectively, a layer with a thickness of 50 μm (whose spectral transmittance is as shown in FIG. 27) as the atmospheric layer, and the MCP of the characteristic shown in FIG. 4A as the detector 5. As is apparent from this diagram, by combining substances different from each other as in the foregoing to construct the window members, the substance transmitting the X-rays to some extent in the low energy region (namely, on the long wavelength side) can also be utilized as the window member if the Al filter with such a thickness is used alone. That is, it will be noted from FIG. 24 that the wavelength region detected with the S/N ratio of more than 10% is reduced to the extent of less than 41 Å.

SEVENTH EMBODIMENT

Figure 28:
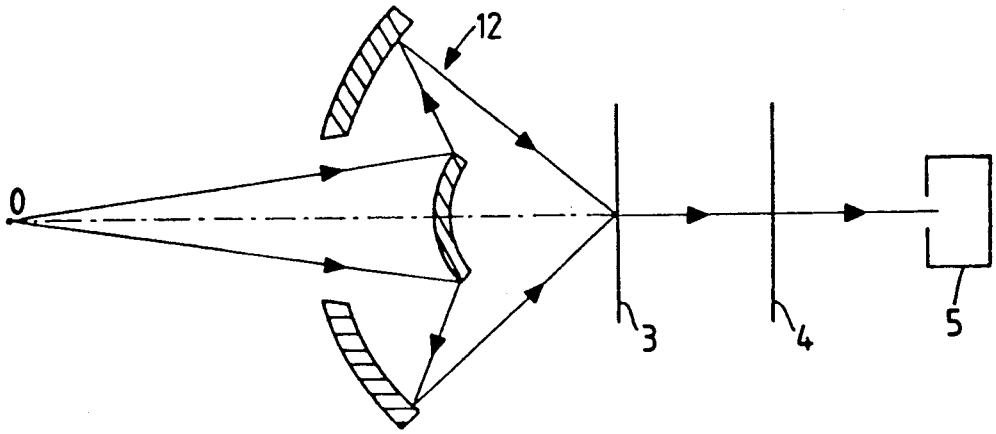
FIG. 28 is a view showing the optical system of a seventh embodiment.

FIG. 28 is a schematic view showing the arrangement of a Schwarzschild type soft X-ray scanning microscope. In this case, the radiation radiating from the X-ray source O and converged by a Schwarzschild optical system 12 is incident on and transmitted through the specimen placed on the stage 3 and after passing through the X-ray filter 4, is detected by the detector 5.

Figure 29:
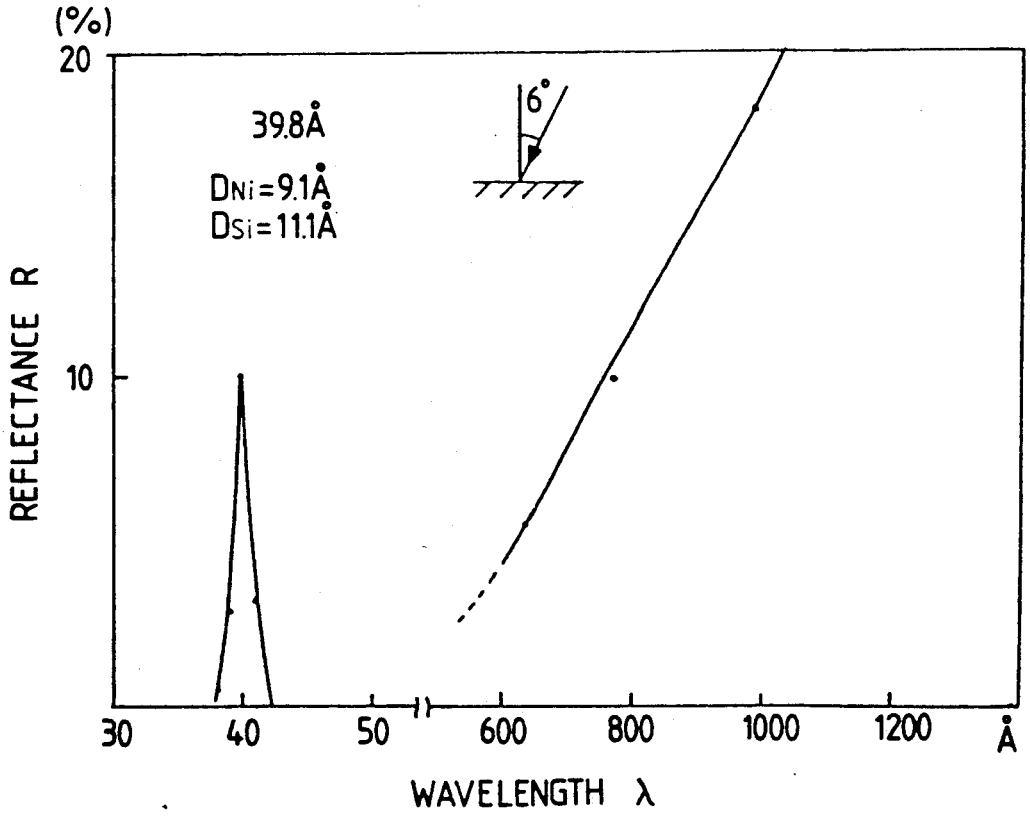
FIG. 29 is a diagram showing the wavelength dispersion property of a multilayer film in the Schwarzschild optical system of the seventh embodiment.

The Schwarzschild optical system, as depicted in FIG. 29, possesses per se remarkable properties of wavelength dispersion in a soft X-ray region due to the effect of multilayer films applied to the mirror surfaces of individual reflecting mirrors [FIG. 29 indicates the property of wavelength dispersion of the multilayer film alternately laminated with 201 Ni-Si layers which is optimally designed under the conditions of a wavelength of 39.8 Å and an incident angle of 6°]. For the radiation of the long wavelength beyond the vacuum ultraviolet rays, however, the reflectance increases again, so that the X-ray filter 4 is effective to cut such radiation.

Figure 30:
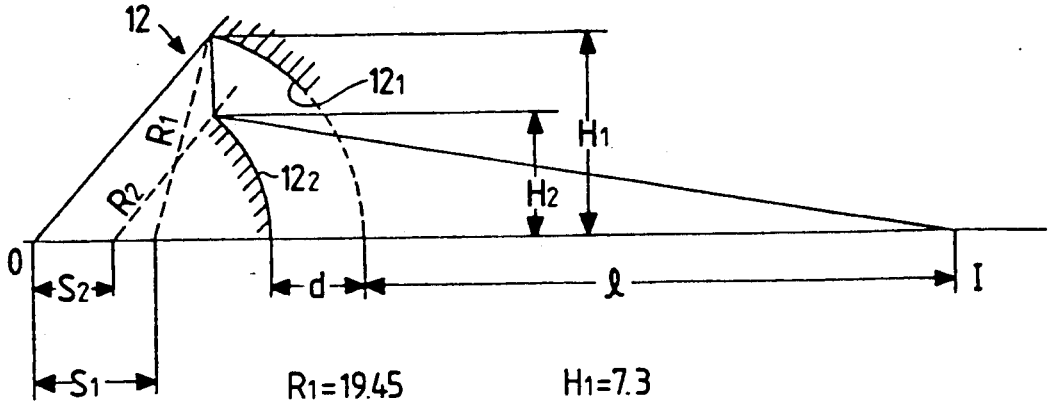
FIGS. 30 and 31 are diagrams showing the Schwarzschild optical system favorable for the seventh embodiment and the wavelength dependence of converging efficiency thereof, respectively.

FIG. 30 depicts the Schwarzschild optical system with a numerical aperture of 0.25 on the specimen side and a magnification of 100× which is favorable for this embodiment, and a concave mirror $12_1$ and a convex mirror $12_2$ constituting the optical system are coated with the multilayer films of the following specification:

| 201 Ni—Si layers | | |
|---|---|---|
| Film thickness | Concave mirror $12_1$ | Ni = 9.1 Å<br>Si = 11.1 Å |
| | Convex mirror $12_2$ | Ni = 9.2 Å<br>Si = 11.3 Å |

Figure 31:
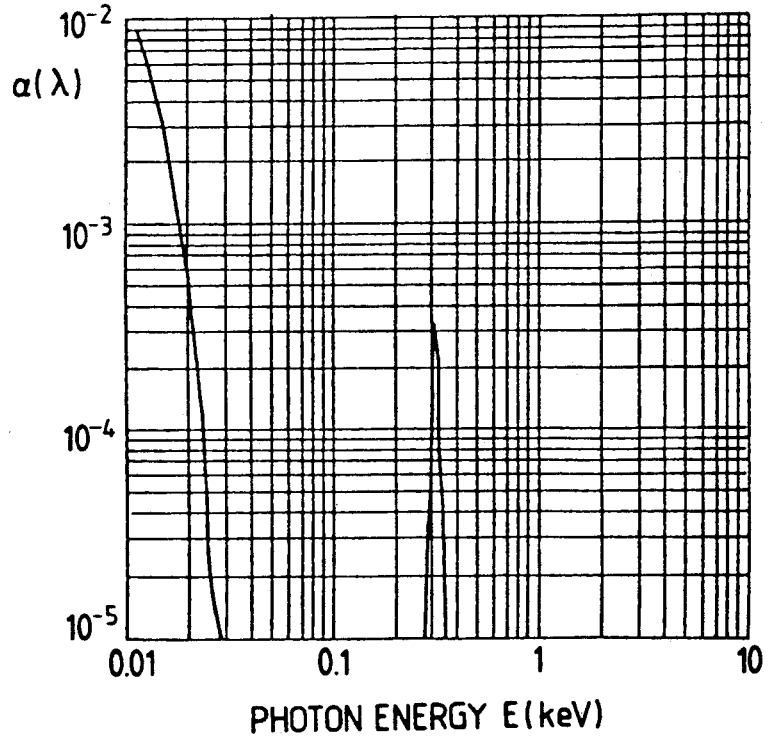

FIG. 31 shows the wavelength (that is, energy) dependence of the convergent efficiency α(λ) in the Schwarzschild optical system.

Figure 32:
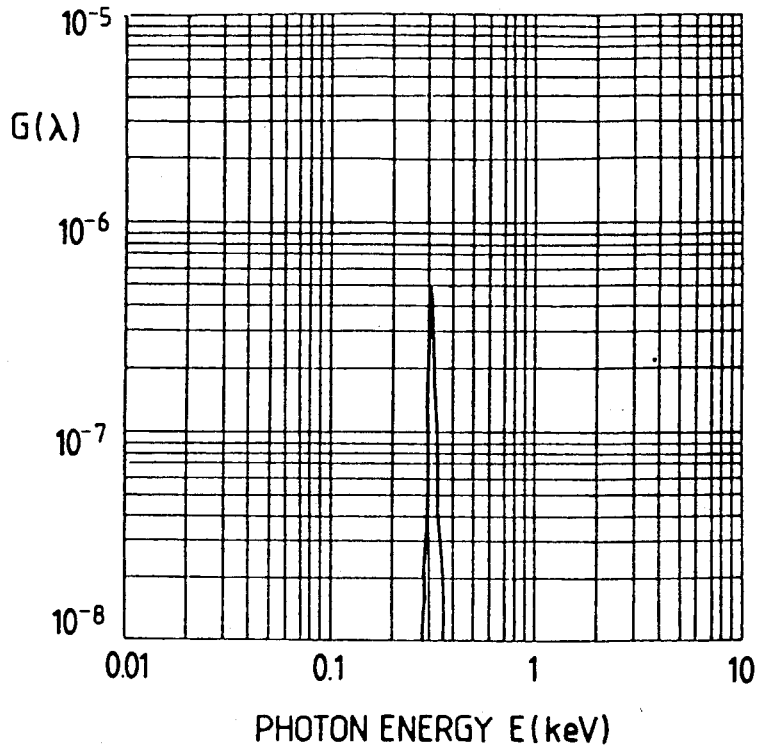
FIG. 32 is a diagram showing the detecting efficiency of particular wavelengths in a concrete example of the seventh embodiment.
Figure 33:
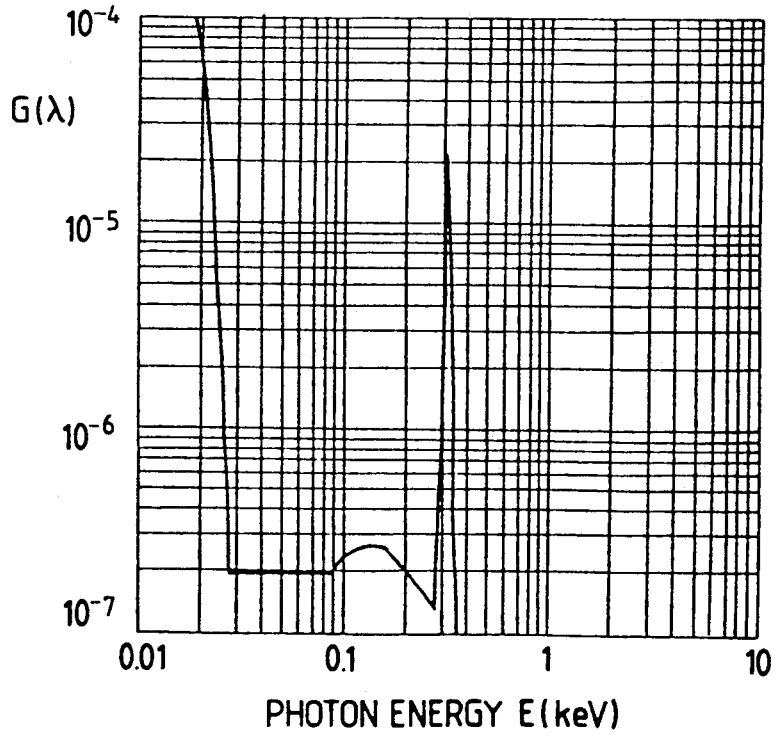
FIG. 33 is a diagram showing the detecting efficiency of particular wavelengths in a comparison example relating to the seventh embodiment.

FIG. 32 shows the detecting efficiency G(λ) calculated from Equation (3) in regard to the X-ray microscope constructed by the combination in which the multilayer film Schwarzschild optical system such as is shown in FIG. 30 is adopted as the converging optical system, the synchrotron radiation source emitting the radiation with the spectrum shown in FIG. 1A as the X-ray source, the filter having the spectral transmittance shown in FIG. 6, namely, a 0.5-μm-thick Fe filter, as the X-ray filter 4, and the MCP of the characteristic shown in FIG. 4A as the detector 5. As is obvious from the diagram, it is noted that the long wavelength radiation such as vacuum ultraviolet rays is cut in comparison with the characteristic of the example (comparison example) making no use of the X-ray filter 4.

EIGHTH EMBODIMENT

Figure 2A:
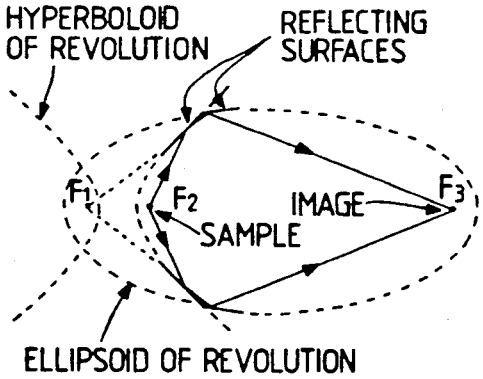
FIG. 2A PRIOR ART
FIGS. 2A, 2B and 2C are views showing Walter optical system, a Schwarzschild optical system, and a zone plate, respectively.
Figure 2B:
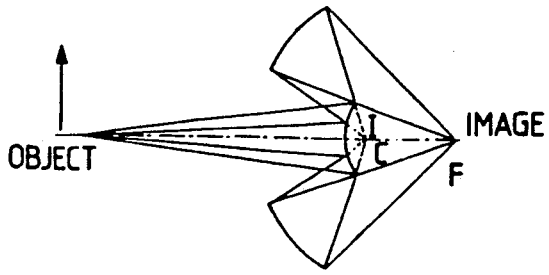
FIG. 2B PRIOR ART
Figure 2C:
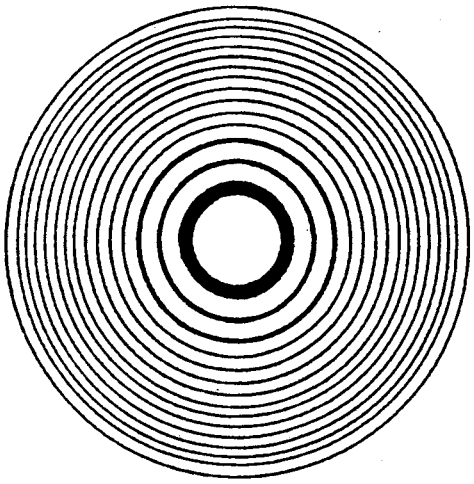
FIG. 2C PRIOR ART
Figure 34:
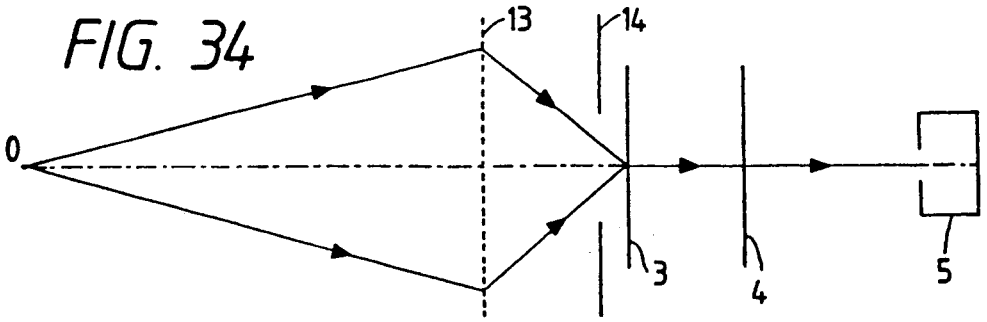
FIGS. 34 to 37 are views showing the optical systems of eighth to eleventh embodiments, respectively.

FIG. 34 is a view showing an outline of the arrangement of a zone plate type soft X-ray scanning microscope. In such an instance, the radiation emitted from the X-ray source O and converged by a zone plate 13 (refer to FIG. 2C) traverses a pinhole 14 to be incident on and transmitted through the specimen on the stage 3 and after passing through the X-ray filter 4, is detected by the detector 5. Also in this embodiment, since the long wavelength radiation diffracted by the pinhole 14 and the short wavelength radiation transmitted therethrough adversely affect image formation, the X-ray filter 4 is available.

NINTH EMBODIMENT

Figure 35:
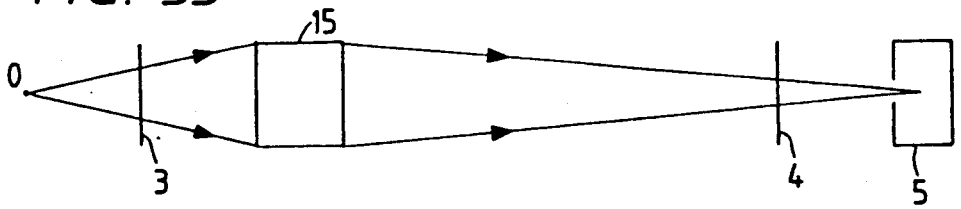

FIG. 35 is a schematic view showing the arrangement of an imaging mode X-ray microscope. The imaging mode, unlike the scanning mode, is such that by forming an image of an object of predetermined size, the image of certain size can be observed without moving the object.

This embodiment is designed so that the specimen on the stage 3 is irradiated with the radiation emitted from the X-ray source O and the radiation transmitted through the specimen is imaged by an imaging optical system 15, thereby causing the image of the specimen to be formed through the X-ray filter 4 at the position of the detector 5. A condenser lens may be disposed between the X-ray source O and the specimen, as necessary.

TENTH EMBODIMENT

Figure 36:
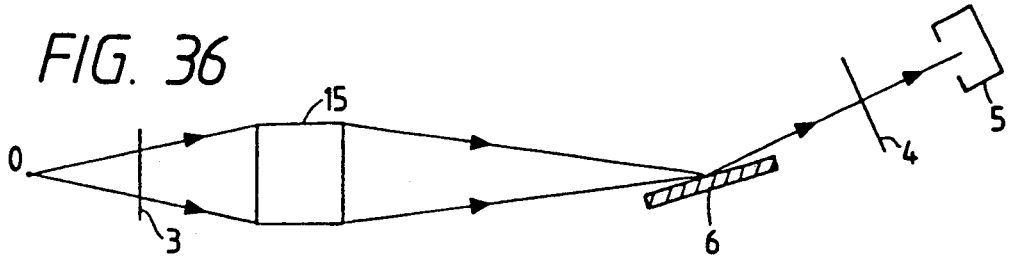

FIG. 36 shows a schematic arrangement of the imaging mode X-ray microscope constructed so that in the optical system of FIG. 35, the grazing incidence mirror 6 is disposed at the imaging position of the specimen secured by the imaging optical system and the radiation transmitted through the specimen is reflected from the grazing incidence mirror 6 to enter the detector 5 through the X-ray filter 4.

ELEVENTH EMBODIMENT

Figure 37:
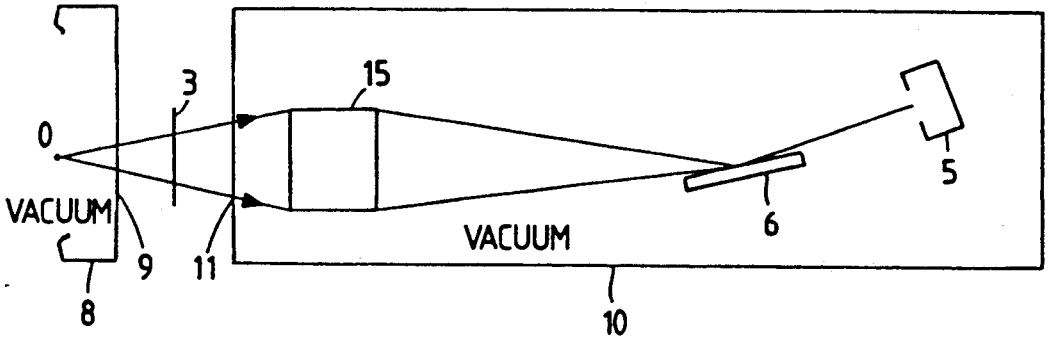

FIG. 37 shows a schematic arrangement of an imaging mode X-ray microscope for microscopy of biological specimens which comprises the optical system of FIG. 35 or 36 incorporated in the vacuum chambers 8 and 10, except for the stage 3.

What is claimed is:

1. An X-ray microscope comprising:

an X-ray source;

a converging optical system collecting radiation emitted from the X-ray source;

a stage on which an object illuminated by X rays from the X-ray source is placed;

an objective optical system collecting radiation from the object;

a detector for receiving radiation through the objective optical system, said detector having sensitivity with respect to radiation of wavelengths ranging from an X-ray region to a vacuum ultraviolet ray region;

wherein a first filter means for eliminating long wavelength components from the radiation emitted from said X-ray source is disposed in an optical path extending between said X-ray source and said detector; and a second filter means for eliminating short wavelength components from the radiation emitted from said X-ray source is disposed in said optical path.

2. The microscope according to claim 1, wherein said converging optical system is one of a Walter optical system, a Schwarzschild optical system and a zone plate.

3. The microscope according to claim 1, wherein said second filter means has a property of eliminating components of short wavelengths of less than 10 Å.

4. The microscope according to claim 1, wherein said first filter means is an absorption filter absorbing a part of the radiation emitted from said X-ray source and said second filter means is a grazing incidence mirror reflecting a part of the radiation emitted from said X-ray source.

5. The microscope according to claim 4, wherein said source, said converging optical system and said detector are arranged in vacuum vessels so that a sample is irradiated with X rays through a first window provided in one of said vessels and said detector receives the X rays from the sample through a second window provided in the other, and at least one of said first and second windows constitutes said first filter means.

6. The microscope according to claim 5, wherein said sample is arranged in the atmosphere interposed between said windows and a layer of the atmosphere constitutes said first filter means.

7. The microscope according to any one of claims 1, 4, 5 or 6, wherein said first filter means has a property of eliminating components of long wavelengths of more than 100 Å.

8. The microscope according to claim 6, wherein said first filter means is set to a cutoff wavelength of nearly 41 Å.

9. The microscope according to claim 4, wherein said first filter means is set to a cutoff wavelength of nearly 55 Å.

10. The microscope according to claim 4, wherein said second filter means is set to a cutoff wavelength of nearly 18 Å.

11. The microscope according to claim 4, wherein said first filter means includes a layer made of one of Fe, Ni, Al and Be.

12. The microscope according to claim 4, wherein said second filter means comprises a reflecting mirror made of Pt.

13. The microscope according to claim 4, wherein said first filter means is set to a cutoff wavelength of nearly 41 Å.

14. The microscope according to claim 6, wherein said first filter means is set to a cutoff wavelength of nearly 60 Å.

15. The microscope according to claim 4, wherein said second filter means is set to a cutoff wavelength of nearly 15 Å.

* * * * *